US006304069B1

(12) United States Patent
Tatsumi

(10) Patent No.: US 6,304,069 B1
(45) Date of Patent: Oct. 16, 2001

(54) LOW POWER CONSUMPTION MULTIPLE POWER SUPPLY SEMICONDUCTOR DEVICE AND SIGNAL LEVEL CONVERTING METHOD THEREOF

(75) Inventor: Takashi Tatsumi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/626,461

(22) Filed: Jul. 26, 2000

(30) Foreign Application Priority Data

Jan. 26, 2000 (JP) ..... 12-17516

(51) Int. Cl.[7] ..... G05F 3/04
(52) U.S. Cl. ..... 323/312
(58) Field of Search ..... 323/312, 313, 323/282; 363/59, 60, 62; 365/205, 206, 207; 326/80

(56) References Cited

U.S. PATENT DOCUMENTS 5,903,142 * 5/1999 Mann ..... 323/313
6,140,855 * 10/2000 Kirihata et al. ..... 327/200
6,236,605 * 5/2001 Mori et al. ..... 365/205

FOREIGN PATENT DOCUMENTS 59-139725 8/1984 (JP) .
9-148913 6/1997 (JP) .

* cited by examiner

*Primary Examiner*—Adolf Deneke Berhane
(74) *Attorney, Agent, or Firm*—Burns, Doane, Swecker & Mathis, LLP

(57) ABSTRACT

A multiple power supply semiconductor device includes a first semiconductor circuit for transferring signals with a signal level of a first voltage, a second semiconductor circuit for transferring signals with a signal level of a second voltage lower than the first voltage, a level shifter for converting a level of an output signal from the second semiconductor circuit to a third voltage higher than the first voltage, and a circuit for further converting the level of the signal whose level is converted to the third voltage to the first voltage to be supplied to the first semiconductor circuit. This makes it possible to implement a multiple power supply semiconductor device with low power consumption and small hardware volume.

4 Claims, 3 Drawing Sheets

LOW POWER CONSUMPTION MULTIPLE POWER SUPPLY SEMICONDUCTOR DEVICE AND SIGNAL LEVEL CONVERTING METHOD THEREOF

BACKGROUND OF THE INVENTION

1. Field of the Invention

The present invention relates to a multiple power supply semiconductor device and a signal level converting method in the device, and particularly to a multiple power supply semiconductor device and a signal level converting method that can implement low power consumption with small hardware volume.

2. Description of Related Art

FIG. 3 is a block diagram showing a configuration of a multiple power supply semiconductor device to which a conventional signal level converting method is applied. In this figure, the reference numeral 1 designates an SDRAM core; 2 designates its power supply; 3 designates a supply voltage converter; 4 designates a logic circuit; 5 designates an SDRAM test circuit; 6 designates a level shifter; 7 designates an input-output circuit; and 8 designates an input-output level converter.

The individual semiconductor circuits in the multiple power supply semiconductor device consist of transistors with different withstanding voltages due to differences in gate oxide thickness. In the present example as shown in FIG. 3, since the SDRAM core 1 is provided not only with a 3.0 V supply voltage, but also with a 2.5 V supply voltage output from the supply voltage converter 3, it employs two types of transistors: first transistors with a gate oxide thickness Tox of 57 Å and a withstanding voltage of 2.7 V; and second transistors with a gate oxide thickness Tox of 75 Å and a withstanding voltage of 4.0 V. On the other hand, since the logic circuit 4, SDRAM test circuit 5 and level shifter 6 are provided only with a 1.3 V supply voltage, or with the 1.3 V supply voltage and the 2.5 V supply voltage output from the supply voltage converter 3, they employ only the first transistors with the gate oxide thickness Tox of 57 Å and the withstanding voltage of 2.7 V.

Next, the operation of the conventional device will be described.

In a normal read operation mode, an input signal from the outside is transferred from the input-output circuit 7 to the input-output level converter 8 which converts the signal level from 3.0 V to 1.3 V. The logic circuit 4, which is fed with the 1.3 V supply voltage, receives the signal whose level is converted to 1.3 V, processes it and provides the processing result to the level shifter 6. Accordingly, the signal level of the signal transferred from the logic circuit 4 to the level shifter 6 is 1.3 V. The level shifter 6, which is provided with the 1.3 V supply voltage and the 2.5 V supply voltage the supply voltage converter 3 produces by converting the 3.0 V supply voltage, converts the level of the signal fed from the level shifter 6 from 1.3 V to 2.5 V, and transfers it to the SDRAM core 1.

The SDRAM core 1 starts its access operation in response to the signal with the 2.5 V signal level transferred from the level shifter 6, and reads data from a designated address. The signal level of the read-out data is 2.5 V. The signal of the read-out data is transferred to the level shifter 6 which converts its level from 2.5 V to 1.3 V, and supplies it to the logic circuit 4. The logic circuit 4 processes the signal of the 1.3 V signal level, and transfers the resultant signal to the input-output level converter 8. The signal transferred from the logic circuit 4 to the input-output level converter 8 has a signal level of 1.3 V. The input-output level converter 8 converts the level of the transferred signal from 1.3 V to 3.0 V, and supplies it to the input-output circuit 7 to be output.

Although the foregoing is the description of the read operation by the SDRAM core 1 in response to the external signal in the normal mode, a write operation to the SDRAM core 1 is carried out in the same manner in response to an external signal.

In an SDRAM test mode, a test of the SDRAM core 1 is carried out in a similar manner as the operation in the normal mode. Specifically, a test signal converted to 1.3 V by the input-output level converter 8 is processed by the SDRAM test circuit 5 in the logic circuit 4, and is transferred to the level shifter 6. The level shifter 6 converts the level of the test signal from 1.3 V to 2.5 V, and transfers it to the SDRAM core 1. Reversely, a response to the test signal is transferred from the SDRAM core 1 to the level shifter 6 which converts its signal level from 2.5 V to 1.3 V. The SDRAM test circuit 5 processes the response signal with the 1.3 V level, and the input-output level converter 8 converts the signal level to 3.0 V to be output. Thus, the integrity of the SDRAM core 1 is verified.

In FIG. 3, the signal flow involved in the normal read/write mode is denoted by thin lines, whereas the signal flow involved in the SDRAM test mode is denoted by thick lines.

Such a conventional signal level converting method is disclosed in Japanese patent application laid-open Nos. 59-139725/1984 and 9-148913/1997, for example.

The conventional signal level converting method thus carried out has the following problems. First, since the level shifter 6 converts the levels of all the signals transferred between the SDRAM core 1 and the logic circuit 4 including the SDRAM test circuit 5, it is unavoidable that the hardware volume grows large. Second, since the supply voltage converter 3 must provide the 2.5 V supply voltage to the level shifter 6 besides the SDRAM core 1, it is necessary to take account of the power consumption of the logic section as well as that of the SDRAM core 1, which requires a large current capacity, resulting in an increase in the hardware volume and power consumption.

SUMMARY OF THE INVENTION

The present invention is implemented to solve the foregoing problems. It is therefore an object of the present invention to provide a multiple power supply semiconductor device and a signal level converting method thereof capable of implementing low power consumption and small hardware volume.

According to a first aspect of the present invention, there is provided a multiple power supply semiconductor device comprising: a first semiconductor circuit for transferring signals with a signal level of a first voltage; a second semiconductor circuit for transferring signals with a signal level of a second voltage lower than the first voltage; a level shifter for converting a level of an output signal from the second semiconductor circuit to a third voltage higher than the first voltage; and a circuit for further converting the level of the signal whose level is converted to the third voltage to the first voltage, to be supplied to the first semiconductor circuit.

Here, the multiple power supply semiconductor device may further comprise a test circuit for generating a test signal with a signal level of the first voltage to checkvalidity of the first semiconductor circuit, wherein the level shifter may supply the first semiconductor circuit with the test signal without changing its signal level.

According to a second aspect of the present invention, there is provided a signal level converting method for converting a level of at least one of signals transferred between a first semiconductor circuit and a second semiconductor circuit, the first semiconductor circuit transferring signals with a signal level of a first voltage, and the second semiconductor circuit transferring signals with a signal level of a second voltage lower than the first voltage, the signal level converting method comprising the steps of: converting a level of an output signal from the second semiconductor circuit to a third voltage higher than the first voltage; and further converting the level of the signal whose level is converted to the third voltage to the first voltage, to be supplied to the first semiconductor circuit.

Here, the signal level converting method may further comprise the steps of: generating a test signal with a signal level of the first voltage to check validity of the first semiconductor circuit; and supplying the first semiconductor circuit with the test signal without changing its signal level.

DETAILED DESCRIPTION OF THE PREFERRED EMBODIMENT

The invention will now be described with reference to the accompanying drawings.

EMBODIMENT 1

Figure 1:
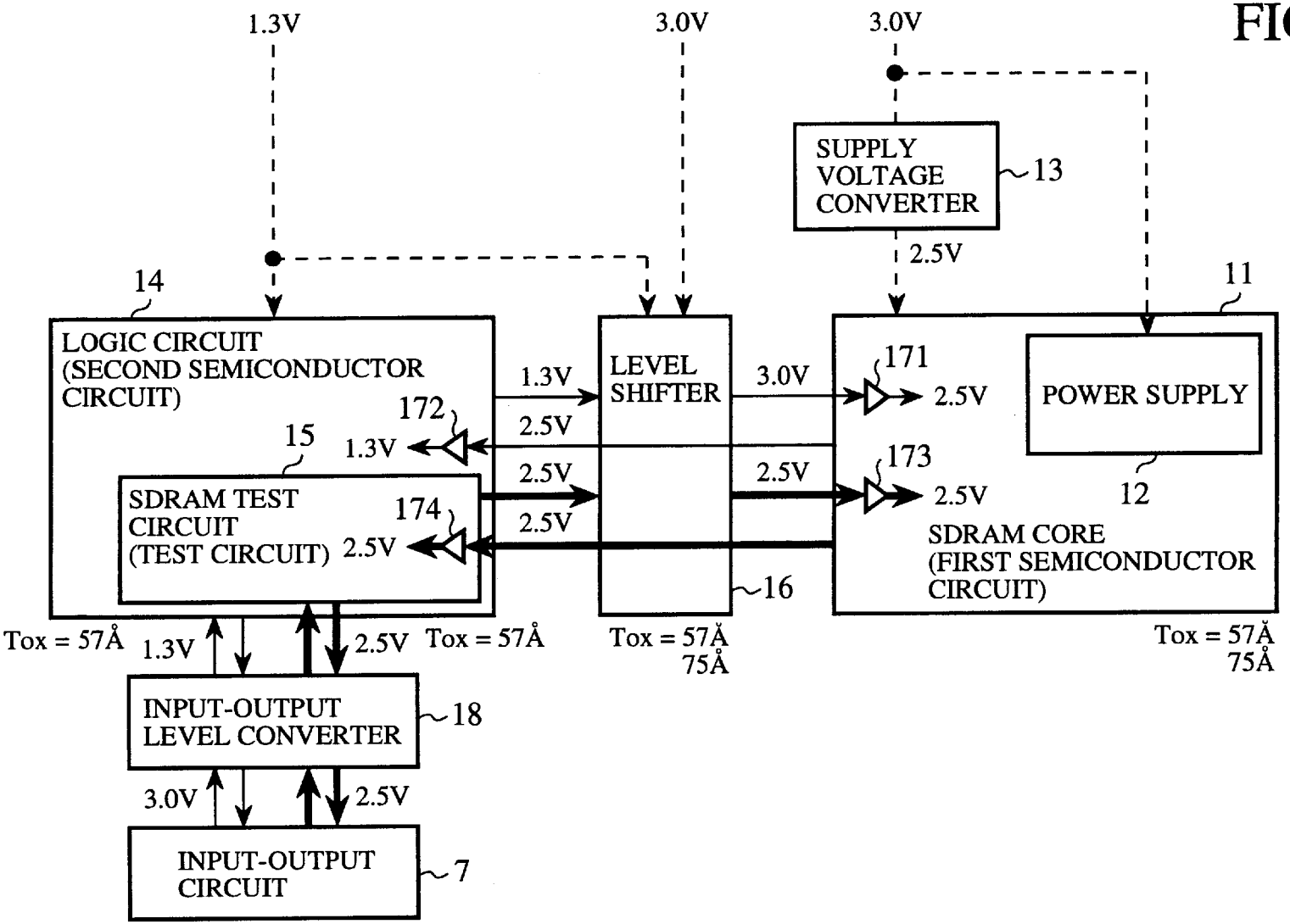
FIG. 1 is a block diagram showing a configuration of an embodiment 1 of a multiple power supply semiconductor device in accordance with the present invention.

FIG. 1 is a block diagram showing a configuration of an embodiment 1 of a multiple power supply semiconductor device in accordance with the present invention. In this figure, the reference numeral 11 designates a first semiconductor circuit which inputs and outputs signals with a signal level of a first voltage (2.5 V). In this figure, an SDRAM core for carrying out read/write of stored data is shown as an example of the first semiconductor circuit. The reference numeral 12 designates a power supply included in the SDRAM core 11 for providing the externally delivered 3.0 V supply voltage to the inside of the SDRAM core 11. The reference 13 designates a supply voltage converter for converting the external 3.0 V supply voltage to the 2.5 V supply voltage, and supplies it only to the SDRAM core 11.

The reference numeral 14 designates a second semiconductor circuit which receives and outputs signals with a second voltage (1.3 V) whose signal level is lower than 2.5 V, the first voltage. Here, a logic circuit for carrying out read/write control of the SDRAM core 11 is taken as an example of the second semiconductor circuit 14. The reference numeral 15 designates a test circuit disposed in the logic circuit 14 for testing the validity of the first semiconductor circuit 11. Here, an SDRAM test circuit is shown for testing the SDRAM core 11 as an example, whose signal level is 2.5 V. T he reference numeral 16 designates a level shifter for converting the level of signals transferred from the logic circuit 14 to the SDRAM core 11 from the second voltage (1.3 V) to a third voltage (3.0 V) higher than the first voltage (2.5 V). The level shifter 16 supplies signals from the SDRAM test circuit 15 to the SDRAM core 11 without converting the level of the signal, that is, with maintaining the signal level a t 2.5 V.

Reference numerals 171–174 each designates an inverter as a gate receiving circuit that receives a signal at its gate. The inverter 171 receives at its gate the signal whose level is converted to 3.0 V by the level shifter 16, and converts the signal level to 2.5 V appropriate as the input to the SDRAM core 11. The inverter 172 receives at its gate the 2.5 V signal directly from the SDRAM core 11 without passing through the level shifter 16, and converts the signal level to 1.3 V appropriate as the input to the logic circuit 14. The inverter 173 receives at its gate the 2.5 V signal, which is produced by the SDRAM test circuit 15 and supplied via the level shifter 16 without undergoing the level conversion, to be supplied to the SDRAM core 11 without changing the signal level. The inverter 174 receives at its gate the 2.5 V signal directly from the SDRAM core 11 without passing through the level shifter 16 to be supplied to the SDRAM test circuit 15 without changing the signal level. Although the inverters with or without the level converting function are employed here as the gate receiving circuits 171–174, other circuits such as NAND circuits or NOR circuits can also be used as long as they receive input signals at their gates.

Figure 3:
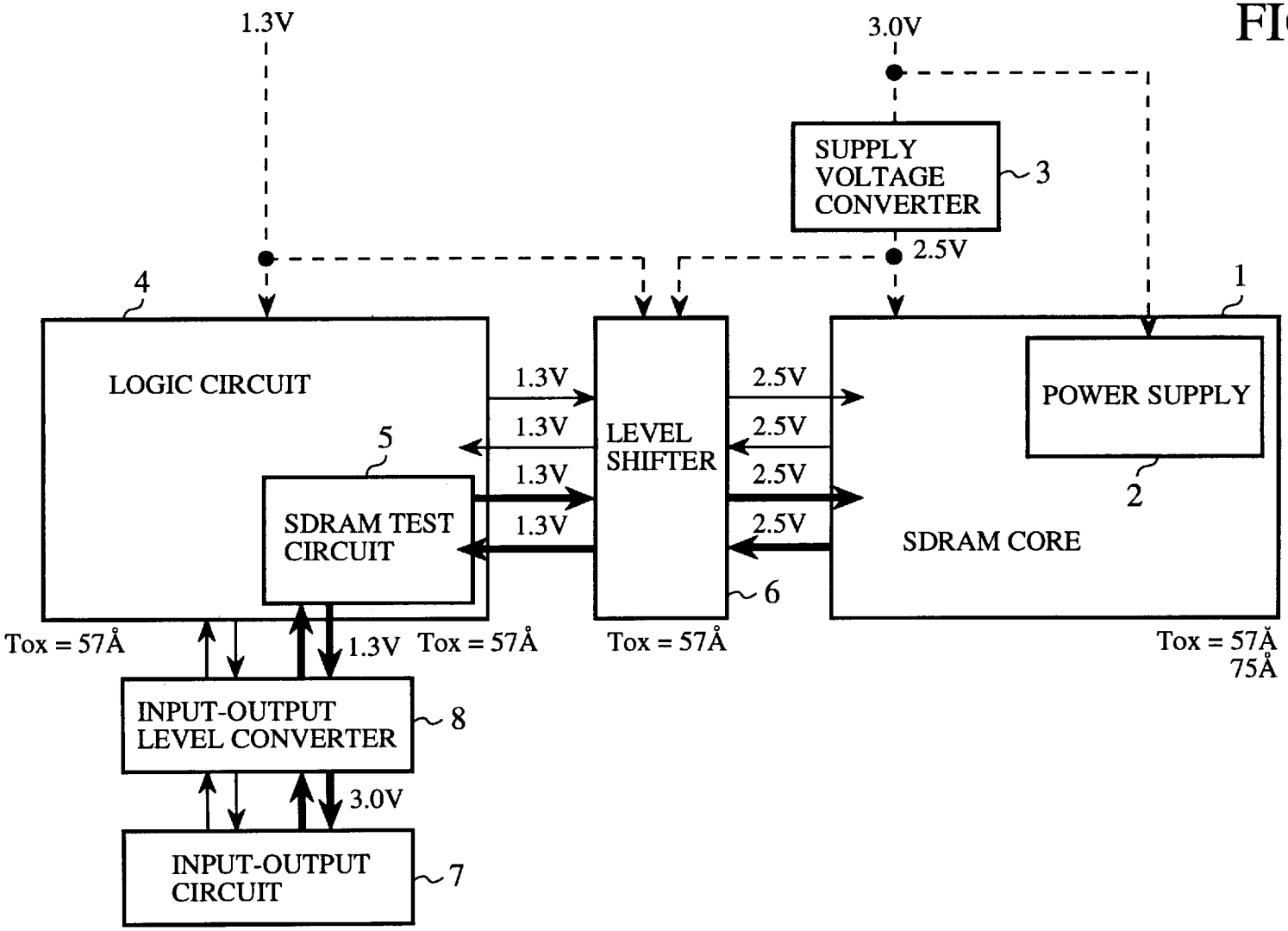
FIG. 3 is a block diagram showing a configuration of a conventional multiple power supply semiconductor device.

The reference numeral 7 designates an input-output circuit equivalent to its counterpart designated by the same reference numeral in FIG. 3; and 18 designates an input-output level converter for converting the level of the signals the input-output circuit 7 inputs and outputs. Although the input-output level converter 18 converts its signal levels between 3.0 V and 1.3 V in the normal read/write operation mode, it maintains the level of its signals at 2.5 V in the SDRAM test mode without carrying out the level conversion.

In the present embodiment 1 of the multiple power supply semiconductor device as shown in FIG. 1, the SDRAM core 11 is supplied with the external 3.0 V supply voltage and the 2.5 V supply voltage the supply voltage converter 13 produces by converting the 3.0 V supply voltage; and the level shifter 16 is supplied with the external 1.3 V supply voltage and the 3.0 V supply voltage. Therefore, they each use two types of transistors: first transistors with a gate oxide thickness Tox of 57 Å and a withstanding voltage of 2.7 V; and second transistors with a gate oxide thickness Tox of 75 Å and a with standing voltage of 4.0 V. On the other hand, since the logic circuit 14 and SDRAM test circuit 15 are supplied only with the 1.3 V supply voltage, they use only the first transistors with the gate oxide thickness Tox of 57 Å and the with standing voltage of 2.7 V.

In the present embodiment 1 also, thin lines denote the signal flow in the normal read/write operation, whereas thick lines denote the signal flow in the SDRAM test mode as shown in FIG. 1.

Next, the operation of the present embodiment 1 will be described.

In the normal read operation mode, the input signal from the outside is input as in the conventional device through the input-output circuit 7 as indicated by the thin line, and is supplied to the input-output level converter 18 that converts its signal level from 3.0 V to 1.3 V, and supplies it to the logic circuit 14. The logic circuit 14 processes the signal whose level is converted to 1.3 V, and supplies the processed result to the level shifter 16. Thus, the level of the signal transferred from the logic circuit 14 to the level shifter 16 10 is 1.3 V. The level shifter 16, which is supplied with the 1.3 V 3.0 V supply voltages, converts the level of the input signal from 1.3 V to 3.0 V.

Figure 2A:
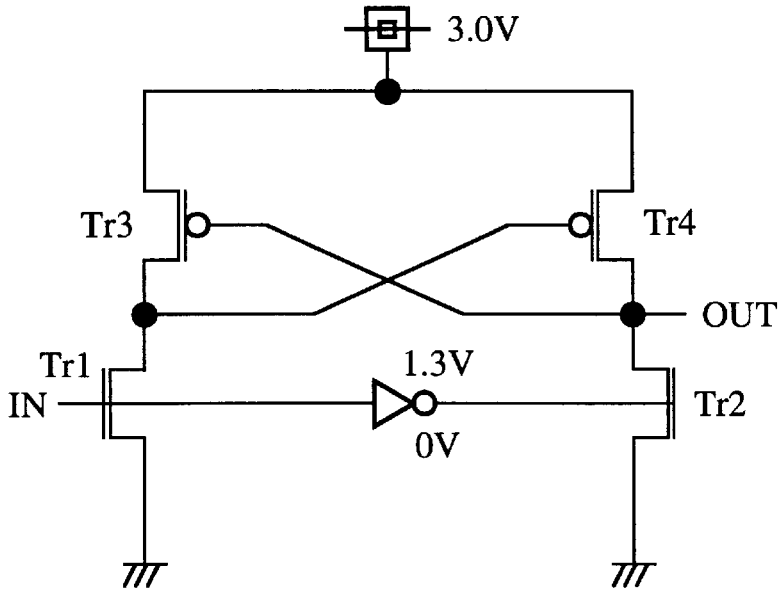
FIGS. 2(*a*)&(*b*) is a circuit diagram showing a converter used by the embodiment 1 of the multiple power supply semiconductor device.
Figure 2B:
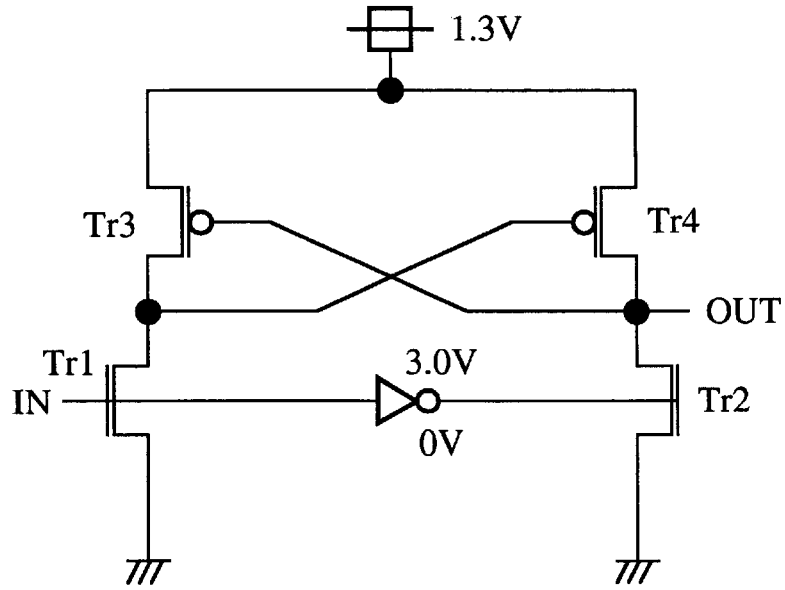

FIGS. 2A and 2B show examples of signal level converters employed by the level shifter 16 and by the input-output level converter 18: FIG. 2A is a circuit diagram showing the converter from 1.3 V to 3.0 V, and FIG. 2B is a circuit diagram showing the converter from 3.0 V to 1.3 V.

In the converter as shown in FIG. 2A, when the input voltage applied to the input terminal IN is placed at 1.3 V, transistors Tr1, Tr2, Tr3 and Tr4 are turned on, off, off and on, respectively, so that the output voltage from the output terminal OUT becomes 3.0 V. In contrast, when the input voltage applied to the input terminal IN is placed at 0 V, transistors Tr1, Tr2, Tr3 and Tr4 are turned off, on, on and off, respectively, so that the output voltage from the output terminal OUT becomes 0 V. Thus, the signal level is converted from 1.3 V to 3.0 V. Likewise, in the converter as shown in FIG. 2B, when the input voltage applied to the input terminal IN is placed at 3.0 V, transistors Tr1, Tr2, Tr3 and Tr4 are turned on, off, off and on, respectively, so that the output voltage from the output terminal OUT becomes 1.3 V. In contrast, when the input voltage applied to the input terminal IN is placed at 0 V, transistors Tr1, Tr2, Tr3 and Tr4 are turned off, on, on and of f, respectively, so that the output voltage from the output terminal OUT becomes 0 V. Thus, the signal level is converted from 3.0 V to 1.3 V.

The 3.0 V signal output from the level shifter 16 is supplied to the gate of the inverter 171 with the gate oxide thickness Tox of 75 Å. The inverter 171 converts the level of the input signal to 2.5 V, and supplies it to the SDRAM core 11 as its access input. The SDRAM core 11 starts its access operation in response to the signal with its level converted to 2.5 V by the inverter 171, and reads data from a designated address. The signal level of the read-out data is 2.5 V. The SDRAM core 11 directly transfers the signal of the read-out data to the logic circuit 14 without passing through the level shifter 16 to be input to the gate of the inverter 172 with the gate oxide thickness Tox of 57 Å. The inverter 172 converts the level of the received signal from 2.5 V to 1.3 V, and supplies its output as the input to the logic circuit 14. The logic circuit 14 processes the 1.3 V signal, and transfers its result to the input-output level converter 18. The level of the signal transferred from the logic circuit 14 to the input-output level converter 18 is 1.3 V. The input-output level converter 18 converts the level of the signal from 1.3 V to 3.0 V, and supplies it to the input-output circuit 7 to be output to the outside.

Although the read operation of the SDRAM core 11 in response to the externally input signal in the normal mode is described, the write operation of the SDRAM core 11 in response to an externally input signal is carried out in the same manner as the read operation.

In the multiple power supply semiconductor device with such a configuration, noise or malfunctions can take place because of a large current flowing through the level shifter 16, and can prevent the validity test of the SDRAM core 11 from being carried out correctly. In this case, not only in the SDRAM test mode, but also in the normal read/write operation mode, the overall operation of the multiple power supply semiconductor device can cause some problems. It is difficult for the conventional signal level converting method in the multiple power supply semiconductor device with the configuration as shown in FIG. 3, to decide as to whether the problem arises in the level shifter 16 or in the SDRAM core 11 because the level shifter 16 is active in shifting the signal levels.

The multiple power supply semiconductor device must operate correctly as a whole system including the level shifter 16. Accordingly, in the SDRAM test mode, it is necessary for the device to test only the SDRAM core 11 to ensure the validity of the SDRAM core 11, thereby making it easy to identify a block involved in a problem. In view of this, in the SDRAM test mode, it is necessary for the level shifter 16 and input-output level converter 18 to be used only as a buffer operating at 2.5 V to carry out the test.

The operation in the SDRAM test mode will now be described.

In the SDRAM test mode, the input-output level converter 18 is made to operate only as a buffer by replacing the conventional 1.3 V signal (see, FIG. 3), which is transferred between the input-output level converter 18 and the SDRAM test circuit 15 in the logic circuit 14, by a 2.5 V signal, and by replacing the conventional 3.0 V signal, which is transferred between the input-output level converter 18 and the input-output circuit 7, by the 2.5 V signal. The level shifter 16 is also made to operated only as a buffer that transfers the 2.5 V signal supplied from the SDRAM test circuit 15 to the SDRAM core 11 without converting its signal level.

The signal for testing the SDRAM core 11 indicated by the thick line in FIG. 1 is supplied from the input-output circuit 7 to the input-output level converter 18 with maintaining its signal level at 2.5 V. The input-output level converter 18, operating only as a buffer, does not carry out the level conversion. Thus, it supplies the 2.5 V signal to the SDRAM test circuit 15 in the logic circuit 14 without changing its level. The SDRAM test circuit 15 processes the received signal, and generates a test signal with a signal level of 2.5 V to be supplied to the level shifter 16. The level shifter 16, also functioning as a buffer, outputs the signal without changing the 2.5 V signal level, and supplies it to the gate of the inverter 173 with the gate oxide thickness Tox of 75 Å. The inverter 173 transfers it to the SDRAM core 11 without changing its level to be supplied as the access input.

The SDRAM core 11 carries out its access operation in response to the 2.5 V test signal output from the inverter 173, and reads out data from the designated address. The signal level of the read-out data is 2.5 V. The SDRAM core 11 directly transfers the signal of the read-out data to the logic circuit 14 without passing through the level shifter 16 to be input to the gate of the inverter 174 with the gate oxide thickness Tox of 57 Å. The 2.5 V signal received by the inverter 174 is supplied as the in put to the SDRAM test circuit 15. The SDRAM test circuit 15 in the logic circuit 14 processes the 2.5 V signal, and transfers its result to the input-output level converter 18. The input-output level converter 18, functioning only as a buffer in the SDRAM test mode, transfers the received signal to the input-output circuit 7 with maintaining its level at 2.5 V. Thus, the input-output circuit 7 outputs the signal to the outside. In this way, the validity of the SDRAM core 11 is checked.

Although the test operation of the SDRAM core 11 in the read operation is described, the test operation of the SDRAM core 11 in the write operation is carried out in the same manner as the read operation.

As described above, the present embodiment 1 is configured such that it is unnecessary for the level shifter 16 to convert the levels of the signals transferred between the SDRAM core 11 and the SDRAM test circuit 15, and for the supply voltage converter 13 to supply the 2.5 V supply voltage to the level shifter 16, but only to the SDRAM core 11. This offers advantages of being able to reduce the hardware volume, and to implement the signal level converting method with small power consumption. Furthermore, the level shifter 16 and input-output level converter 18 operate only as a buffer in the SDRAM test mode, which offers an advantage of being able to test the validity of the SDRAM core 11 independently of the effects of the level shifter 16 and input-output level converter 18.

What is claimed is:

1. A multiple power supply semiconductor device comprising:

a first semiconductor circuit for transferring signals with a signal level of a first voltage;

a second semiconductor circuit for transferring signals with a signal level of a second voltage lower than the first voltage;

a level shifter for converting a level of an output signal from the second semiconductor circuit to a third voltage higher than the first voltage; and a circuit for further converting the level of the signal whose level is converted to the third voltage to the first voltage, to be supplied to the first semiconductor circuit.

2. The multiple power supply semiconductor device according to claim 1, further comprising a test circuit for generating a test signal with a signal level of the first voltage to check validity of the first semiconductor circuit, wherein said level shifter supplies the first semiconductor circuit with the test signal without changing its signal level.

3. A signal level converting method for converting a level of at least one of signals transferred between a first semiconductor circuit and a second semiconductor circuit, the first semiconductor circuit transferring signals with a signal level of a first voltage, and the second semiconductor circuit transferring signals with a signal level of a second voltage lower than the first voltage, said signal level converting method comprising the steps of:

converting a level of an output signal from the second semiconductor circuit to a third voltage higher than the first voltage; and further converting the level of the signal whose level is converted to the third voltage to the first voltage, to be supplied to the first semiconductor circuit.

4. The signal level converting method according to claim 3, further comprising the steps of:

generating a test signal with a signal level of the first voltage to check validity of the first semiconductor circuit; and supplying the first semiconductor circuit with the test signal without changing its signal level.

* * * * *